US009318042B2

(12) United States Patent
Shin et al.

(10) Patent No.: US 9,318,042 B2
(45) Date of Patent: Apr. 19, 2016

(54) DISPLAY DEVICE AND CONTROL METHOD THEREOF

(71) Applicant: SAMSUNG DISPLAY CO., LTD., Gyeonggi-do (KR)

(72) Inventors: Kwang-Suk Shin, Gyeonggi-do (KR); Weon-Jun Choe, Gyeonggi-do (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 157 days.

(21) Appl. No.: 14/030,336

(22) Filed: Sep. 18, 2013

(65) Prior Publication Data

US 2014/0354699 A1 Dec. 4, 2014

(30) Foreign Application Priority Data

May 29, 2013 (KR) ..... 10-2013-0061124

(51) Int. Cl.

*G09G 3/20* (2006.01)
*G09G 3/00* (2006.01)
*G09G 3/32* (2006.01)

(52) U.S. Cl.

CPC ..... *G09G 3/2022* (2013.01); *G09G 3/003* (2013.01); *G09G 3/3233* (2013.01); *G09G 2300/0842* (2013.01); *G09G 2320/0247* (2013.01); *G09G 2340/16* (2013.01); *G09G 2360/16* (2013.01)

(58) Field of Classification Search

CPC combination set(s) only.
See application file for complete search history.

(56) References Cited

U.S. PATENT DOCUMENTS

| | | | | |
|---|---|---|---|---|
| 2007/0200803 | A1* | 8/2007 | Kimura | 345/76 |
| 2008/0180367 | A1* | 7/2008 | Lee | 345/80 |
| 2008/0238328 | A1* | 10/2008 | Shin et al. | 315/169.3 |
| 2008/0316232 | A1* | 12/2008 | Ryu et al. | 345/690 |
| 2009/0033602 | A1* | 2/2009 | Alexander et al. | 345/77 |
| 2009/0147032 | A1* | 6/2009 | Kim | 345/690 |
| 2011/0050754 | A1* | 3/2011 | Hyun | 345/690 |
| 2012/0044270 | A1* | 2/2012 | Arkhipov et al. | 345/690 |
| 2013/0201223 | A1* | 8/2013 | Li et al. | 345/690 |
| 2014/0104258 | A1* | 4/2014 | Oh et al. | 345/211 |

FOREIGN PATENT DOCUMENTS

| | | |
|---|---|---|
| KR | 1020080000149 | 1/2008 |
| KR | 1020090040541 | 4/2009 |
| KR | 1020120017968 | 2/2012 |
| KR | 1020120114989 | 10/2012 |

* cited by examiner

*Primary Examiner* — Kumar Patel
*Assistant Examiner* — Amy C Onyekaba
(74) *Attorney, Agent, or Firm* — F. Chau & Associates, LLC

(57) ABSTRACT

A display device for sequentially displaying a plurality of subframes (images) within one frame period according to an image source signal, the device including: a pixel array including a plurality of pixels; a scale factor generator configured to separately calculate electric current values of the electric to be consumed by each of the plurality of respective subframes (per frame period), and to calculate an initial scale factor by comparing the electric current value with a threshold electric current value, and to generate a correction scale factor (for each among the plurality of subframes) of the first frame by using the initial scale factor and a correction scale factor of a previous frame (previous to the first frame) (and of the same subframe index) corresponding to the initial scale factor; and an image processor configured to convert a gray data of the image source signal of the first frame.

21 Claims, 11 Drawing Sheets

DISPLAY DEVICE AND CONTROL METHOD THEREOF

CROSS-REFERENCE TO RELATED APPLICATION

This application claims priority to and the benefit of Korean Patent Application No. 10-2013-0061124 filed in the Korean Intellectual Property Office on May 29, 2013, the entire contents of which are incorporated by reference herein.

1. Technical Field

Embodiments of the inventive concept relate to a display device and a control method thereof, and more particularly, to a driving control apparatus and a control method of a display device that remove a flicker, and a display device using the same, when one or more subframes are alternately displayed.

2. Description of the Related Art

A display device may display at least one image within one frame period according to a driving frequency of the display device. In other words, the display device may alternately display different images (e.g., subframes) within one frame period.

For example, the driving frequency of the display device is 120 Hz and a frame frequency of each of an image source signal of a first image and an image source signal of a second image is 12 Hz, a total of ten sheets of first images and second images may be alternately displayed within one frame period.

In such a condition, the display device may perform image processing such as gray data conversion for the first images (subframes) and the second images (subframes). However, image processing for a plurality of subframes in which different image processing needs to be performed is not respectively performed.

A difference in image quality between the first image and the second image and a flicker between the first image and the second image are generated due to the problem.

SUMMARY

An aspect of the inventive concept provides a display device and a driving method having the capability of displaying a stereoscopic image or a plane image in an environment requiring at least one of enlargement and high resolution of the display device.

An aspect of the inventive concept provides a display device and a driving method the capability of removing flicker among a plurality of subframes (images) according to image processing, when the plurality of subframes is displayed within one frame.

Embodiments of the inventive concept provide a display device displaying a plurality of subframes (images) within one frame period according to an image source signal, the device including: a pixel array including the plurality of pixels; a scale factor generator configured to separately calculate electric current values to be consumed by each of the plurality of subframes displayed within a first frame period, calculate an initial scale factor by comparing each of the electric current values with a threshold electric current value, and generate a correction scale factor of the first frame by using the initial scale factor and a correction scale factor of a previous frame (previous to the first frame) (and of the same subframe number) corresponding to the initial scale factor; and an image processor configured to convert a gray data of the image source signal of the first frame by using the correction scale factor of the first frame.

The initial scale factor may be arranged in the arranged order of the plurality of subframes within one frame period.

The scale factor generator may include a data calculator configured to calculate the initial scale factor by using the image source signal; and a plurality of filter units configured to correct the initial scale factor by using the difference [i.e., the difference between a correction scale factor of a previous frame (and of the same subframe number) corresponding to the initial scale factor and the initial scale factor] to generate a correction scale factor of the first frame.

The scale factor generator may further include a scale factor separator that separates the initial scale factor to correspond to each of the plurality of subframes according to a scale factor division signal and outputs each of the separated scale factors to the filter unit corresponding to that separated scale factor.

The scale factor generator may further include a first memory that delays a correction scale factor of a previous frame to output the delayed correction scale factor (back) to the filter unit.

The image processor may include a pixel data converter for converting a gray data by multiplying the image source signal of the first frame by a correction scale factor of the first frame.

The image processor may include a second memory for delaying the image source signal of the first frame to output the delayed image source signal to the pixel data converter based on a period when the corrected scale factor is outputted from the scale factor generator.

The image source signal may be arranged in the order where the plurality of subframes is sequentially displayed in the pixel array within one frame period.

The plurality of subframes may be separated and arranged by a plurality of unit display periods within one frame period.

The initial scale factor and the correction scale factor are larger than 0 and equal to or smaller than 1.

An aspect of the inventive concept provides a control method of a display device, including: calculating electric current values to be consumed in a pixel array by each of a plurality of respective subframes displayed within a first frame period according to an image source signal; calculating an initial scale factor by comparing the electric current value with a threshold electric current value; correcting the initial scale factor by using a correction scale factor of a previous frame (previous to the first frame) (and of the same subframe index) corresponding to the initial scale factor; and converting a gray data of the image source signal of the first frame by using the correction scale factor.

An aspect of the invention provides a display device for displaying a plurality of subframes within one frame period according to an image source signal, the device comprising: a pixel array including the plurality of pixels; an image processor configured to convert a gray data of the image source signal of a first frame by using first correction scale factors corresponding to its plurality of subframes, and configured to convert a gray data of the image source signal of a second frame by using second correction scale factors corresponding to its plurality of subframes; and a scale factor generator configured to calculate the electric current values to be consumed by each of the plurality of subframes within the first frame period, and configured to calculate the electric current values to be consumed by each of the plurality of subframes within the second frame period, and configured to calculate the initial scale factors for each of the plurality of subframes of the first and second frames by comparing the electric current values with a threshold electric current value, and configured to generate the second correction scale factors by using the initial scale factors of the second frame and the corresponding correction scale factors of the first frame.

In the display device, the second correction scale factors are generated by using each of the initial scale factors of the second frame and the corresponding correction scale factors of the first frame in Equation 2 set forth herein below.

Results of the display device according to exemplary embodiments the inventive concept may be as follows.

According to an exemplary embodiment of the inventive concept, when a plurality of subframes are sequentially displayed within one frame period, it is possible to remove a flicker between the plurality of subframes according to image processing. And other effects not described above will be apparent to those skilled in the art from the disclosure of the inventive concept.

The inventive concept will be described more fully hereinafter with reference to the accompanying drawings, in which exemplary embodiments of the inventive concept are shown. As those skilled in the art would realize, the described embodiments may be modified in various different ways, all without departing from the spirit or scope of the inventive concept.

Accordingly, the drawings and description are to be regarded as illustrative in nature and not restrictive. Like reference numerals designate like elements throughout the specification.

Throughout this specification and the claims that follow, when it is described that an element is "coupled" or "connected" to another element, the element may be "directly coupled" or "directly connected" to the other element or electrically coupled or connected to the other element through a third element.

BRIEF DESCRIPTION OF THE DRAWINGS

The inventive concept will become more apparent in view of the attached drawings and accompanying detailed description. The embodiments depicted therein are provided by way of example, not by way of limitation, wherein like reference numerals refer to the same or similar elements. The drawings are not necessarily to scale, emphasis instead being placed upon illustrating aspects of the inventive concept. In the figures.

DETAILED DESCRIPTION OF THE EXEMPLARY EMBODIMENTS

Figure 1:
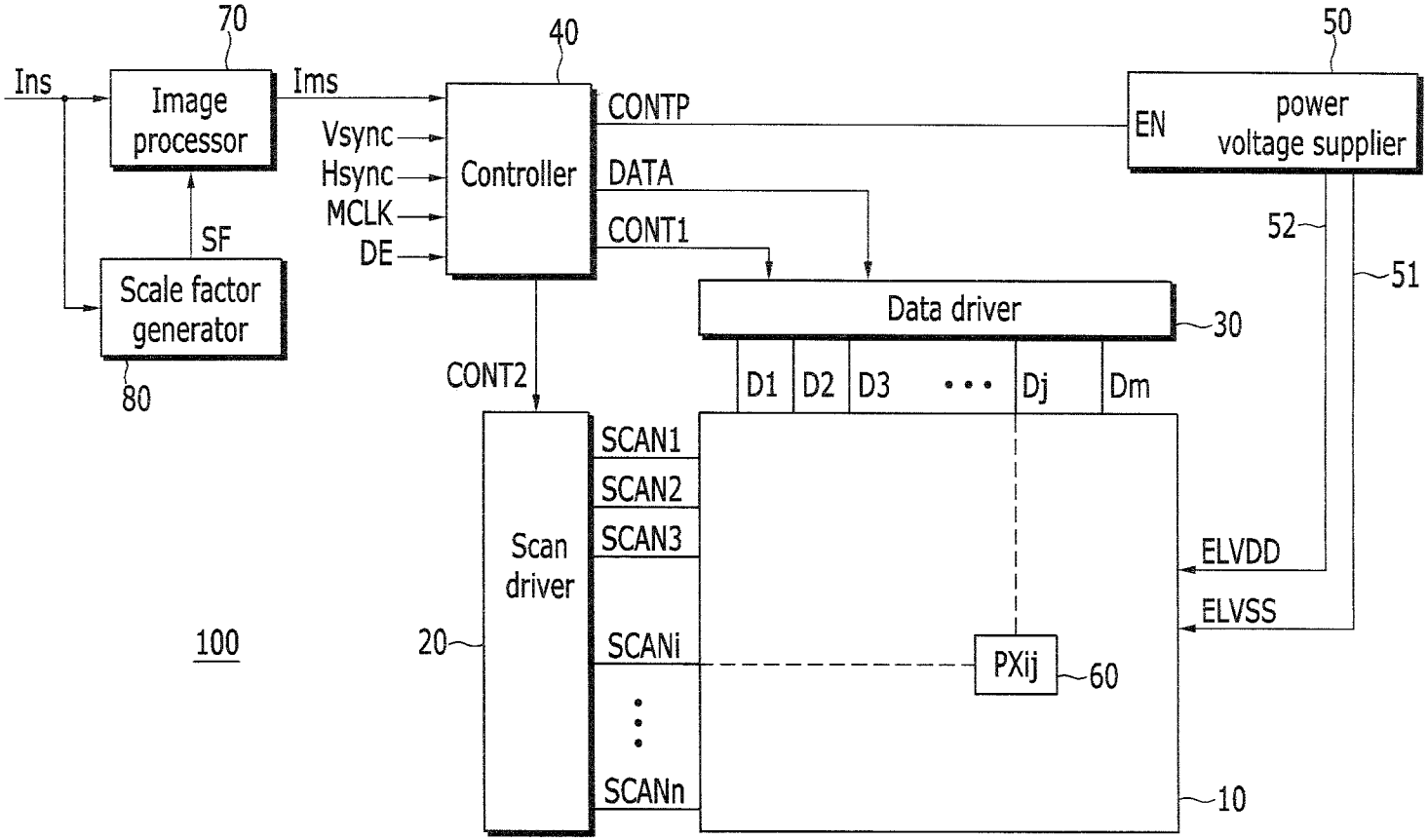
FIG. 1 is a block diagram of a display device according to an exemplary embodiment of the inventive concept.

FIG. 1 is a block diagram of a display device 100 according to an exemplary embodiment of the inventive concept.

Referring to FIG. 1, the display device 100 includes a pixel array 10 including a array of pixels 60, a scan driver 20, a data driver 30, a controller 40, a power voltage supplier 50, an image processor 70, and a scale factor generator 80.

The pixel array 10 is a display panel including a plurality of pixels 60 each of which is connected to a corresponding scan line among a plurality of scan lines SCAN1-SCANn and to a corresponding data line among a plurality of data lines D1-Dm. Each of the plurality of pixels corresponds to an image data signal (hereinafter, pixel data voltage) transmitted to the corresponding pixel to display one pixel of an image.

The plurality of pixels included in the pixel array 10 are connected to the plurality of scan lines SCAN1-SCANn and to the plurality of data lines D1-Dm and are arranged substantially in a matrix form. The plurality of scan lines SCAN1-SCANn extend in a row direction to be almost substantially parallel to each other. The plurality of data lines D1-Dm is extend in a column direction to be substantially parallel to each other. Each of the plurality of pixels of the pixel array 10 receives a power voltage from the power voltage supplier 50 and receives a first driving voltage ELVDD and a second driving voltage ELVSS.

The scan driver 20 is connected to the pixel array 10 through the plurality of scan lines SCAN1-SCANn. The scan driver 20 generates a plurality of scan signals capable of activating each pixel of the pixel array 10 according to a scan control signal CONT2 to sequentially transfer the generated scan signals to the corresponding scan line among the plurality of scan lines SCAN1-SCANn.

The scan control signal CONT2 is an operation control signal of the scan driver 20 which is generated and transferred from the controller 40. The scan control signal CONT2 may include a vertical scan start signal, a clock signal, and the like. The vertical scan start signal is a signal that generates the first scan signal among the plurality of sequential scan signals used for displaying an image for one frame. The clock signal is a synchronization signal for applying scan signals to the plurality of scan lines SCAN1-SCANn in sequence.

The data driver 30 is connected to every pixel of the pixel array 10 through the plurality of data lines D1-Dm. The data driver 30 receives an image data signal DATA and transfers a portion of the received image data signal DATA to each data line among the plurality of data lines D1-Dm according to a data control signal CONT1.

The data control signal CONT1 is an operation control signal of the data driver 30 which is generated and transferred from the controller 40.

The data driver 30 selects a 'gray voltage' according to each portion of the image data signal DATA to transfer the selected gray voltage to each of the plurality of data lines D1-Dm as a pixel data voltage.

The controller 40 receives an image display signal ImS which is obtained by image-processing performed by the image processor 70, and an input control signals for controlling the display of the image carried in the image display signal. The image display signal ImS is a digital signal that contains luminance information of each pixel of the pixel array 10, and the luminance is be divided into a predetermined number of grays according to the number of bits per pixel, for example, 1024 (=210), 256 (=28), or 64 (=26) grays.

Meanwhile, an example of the input control signals transferred to the controller 40 includes a vertical synchronization signal Vsync, a horizontal synchronization signal Hsync, a main clock MCLK, a data enable signal DE, and the like.

The controller 40 appropriately processes the image display signal ImS based on the image display signal ImS and upon the input control signals in accordance with the operation condition of the pixel array 10 and of the data driver 30. In more detail, the controller 40 performs digital image processing such as gamma correction and luminance compensation with respect to the digital image display signal ImS to generate the digital image data signal DATA.

Further, the controller 40 transfers a scan control signal CONT2 for controlling the operation of the scan driver 20 to the scan driver 20. The controller 40 generates a data control signal CONT1 for controlling the operation of the data driver 30 and transfers the data control signal CONT1 to the data driver 30 together with the digital image data signal DATA with the image processing.

Next, the controller 40 controls driving of the power voltage supplier 50 by driving signal CONTP. The power voltage supplier 50 supplies a first and second power voltage for driving each pixel of the pixel array 10.

For example, the controller 40 is connected with a driving terminal EN of the power voltage supplier 50 to transfer a driving signal CONTP to the power voltage supplier 50 and to drive the power voltage supplier 50.

Next, the power voltage supplier 50 is electrically connected to each pixel through two power wires which supply the two power voltages to each pixel of the pixel array 10. The two power voltages are the first power voltage ELVDD and the second power voltage ELVSS at a high level.

The image processor 70 according to the exemplary embodiment of the inventive concept generates a digital image display signal ImS and synchronization signals from a received input signal InS. The synchronization signal may include the horizontal synchronization signal Hsync, the vertical synchronization signal Vsync, and the main clock signal MCLK shown as inputs to the controller 40.

In addition, the input signal InS inputted to the image processor 70 may include signals (hereinafter, image source signals RGB, i.e. Red, Green, Blue) representing a plurality of different images.

The image processor 70 receives a scale factor SF for image processing from the scale factor generator 80. In addition, the image processor 70 multiplies the image source signals RGB by the scale factor SF to change the gray level (luminance data) information of the image source signals RGB.

The image processor 70 generates the image display signal ImS from image source signals RGB with the changed gray information and from the scale factor SF. As a result, the electric current consumed in an organic light emitting diode (OLED) of the pixel array 10 may be limited.

Meanwhile, the scale factor generator 80 generates the scale factor SF corresponding to the image source signals RGB when the input signal InS is received. The scale factor generator 80 transmits the scale factor SF to the image processor 70.

A detailed description of an exemplary implementation of the image processor 70 and of the scale factor generator 80 will be described with reference to FIG. 5.

Next, the image source signals RGB inputted to the processor 70 and to the scale factor generator 80 will be described with reference to FIGS. 2 and 3. One unit frame 1 frame comprising the image source signals RGB may include a plurality of sub frames (images). In this case, the plurality of images (sub frames) may be displayed within one frame period base on a frame frequency of the image source signals.

Figure 2:
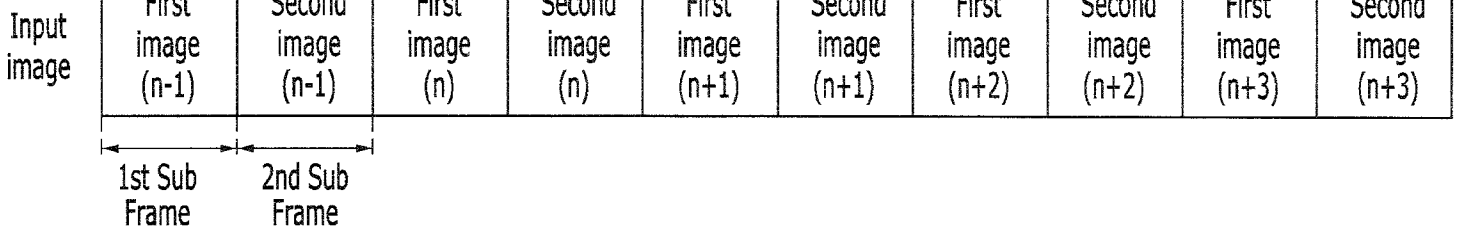
FIG. 2 is a timing diagram illustrating a first image source signal sequence to be displayed by the display device of FIG. 1.

FIG. 2 is an timing diagram of a first image source signal sequence to be displayed by the display device of FIG. 1 according to an exemplary embodiment of the inventive concept. As illustrated in FIG. 2, first and second image source signals RGB include a first image source signal representing a First image and a Second image source signal representing a Second image. And respective sub-frames of the first and second image source signals may be alternately arranged within each one frame unit of the image source signals RGB.

A first image source signal of one frame unit may be arranged in a first sub frame, and a second image source signal of the same one frame unit may be arranged in a second sub frame. The image processor 70 separates a driving frequency of the display device into frame frequencies of the first and second image source signals RGB to determine the arranged number of the first images and the second images.

For example, when the frame frequencies of the first and second image source signals RGB are 12 Hz and the driving frequency is 120 Hz, a divided result value becomes 10. Or, for another example, if the frame frequencies of the first and second image source signals RGB are 1 Hz while the driving frequency is 10 Hz, the divided result value becomes 10.

The driving frequency of subframes is set based on the period when the display device displays the first image (subframe) and the second image (subframe). For example, when the driving frequency is 120 Hz, the display device displays one subframe of the first image for $1/240^{th}$ of a second and displays one subframe of the second image for the next $1/240^{th}$ of the second.

Accordingly, when the divided result value is 10, for one frame of the first and second image source signals, the display device may display 10 sheets of first images and 10 sheets of second images.

One frame of the first image signal and one frame of the second image signal may be displayed during one period operation of the display device. Accordingly, the display device may display 20 subframes within one frame period of the first and second image source signals RGB.

Figure 3:
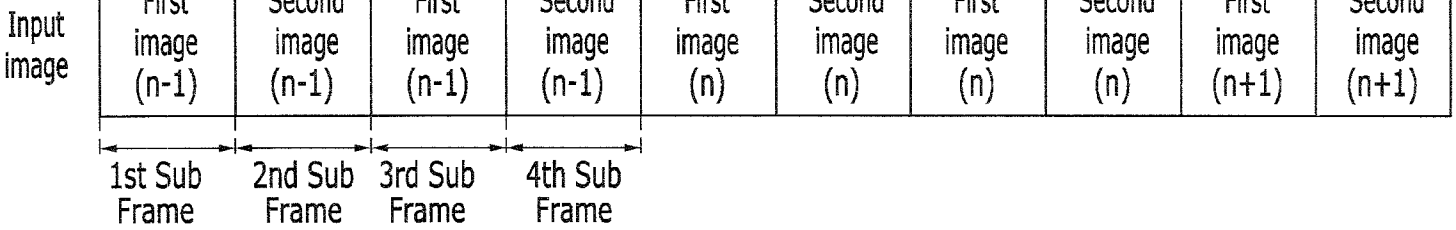
FIG. 3 is a timing diagram illustrating a second image source signal sequence to be displayed by the display device of FIG. 1.

FIG. 3 is an timing diagram illustrating an image source signal according to a second exemplary embodiment of the inventive concept. As illustrated in FIG. 3, first to fourth image source signals RGB include a first image source signal representing a First image in a $1^{st}$ subframe, a second image source signal representing a Second image in a $2^{nd}$ subframe, a third image source signal representing a Third image in a $3^{rd}$ subframe, and a fourth image source signal representing a Fourth image in a $4^{th}$ subframe. And, respective subframes of the first image source signal, the second image source signal, the third image source signal, and the fourth image source signal may be alternately arranged within one frame unit corresponding to the first to fourth image source signals RGB.

The first image source signal of one frame unit may be arranged in the first sub frame, the second image source signal may be arranged in the second sub frame, the third image source signal may be arranged in the third sub frame, and the fourth image source signal may be arranged in the fourth sub frame. The image processor 70 separates a driving frequency of the display device into frame frequencies of the first to fourth image source signals RGB to determine the arranged number (e.g., four) of the images.

For example, when the frame frequency of the image source signals RGB is 12 Hz and the driving frequency of the display device is 120 Hz, a divided result value becomes 10.

Accordingly, within one frame period of the first to fourth image source signals RGB, the display device may display 10 sheets of first images, 10 sheets of second images, 10 sheets of first images, and 10 sheets of second images.

Next, the structure of an exemplary implementation of the pixel 60 of the display device 100 of FIG. 1 according to an exemplary embodiment of the inventive concept will be described with reference to FIG. 4.

Figure 4:
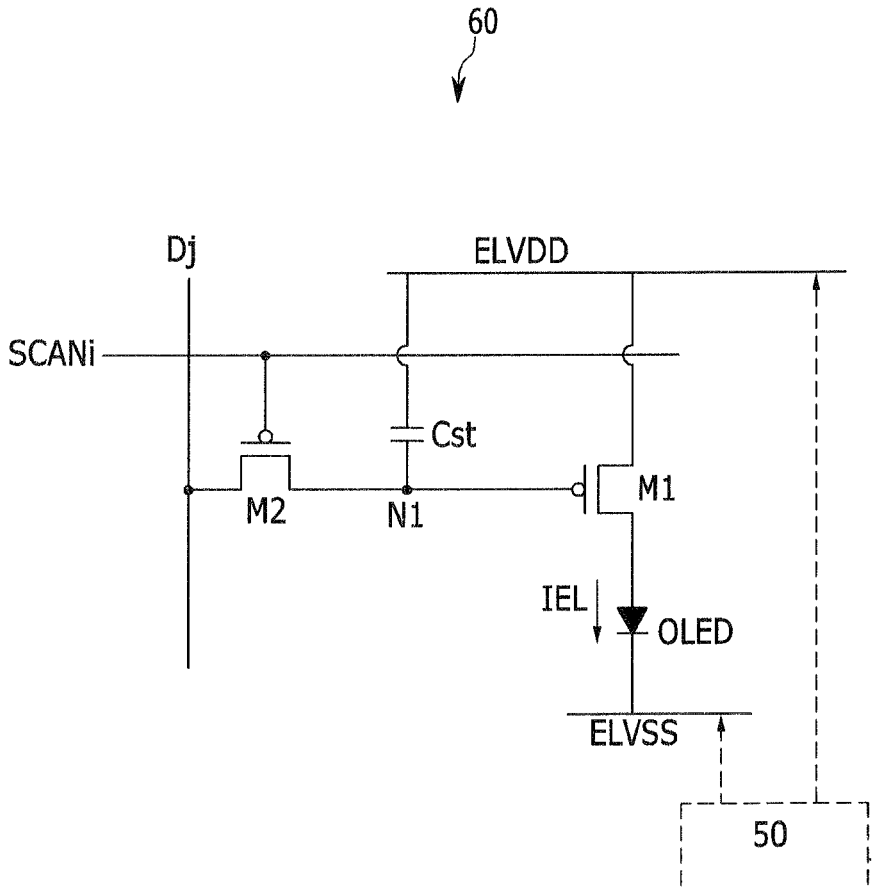
FIG. 4 is a circuit diagram of an exemplary OLED pixel structure included in the pixel array of the display device of FIG. 1.

FIG. 4 is a circuit diagram illustrating an exemplary implementation of the structure of an OLED pixel included in the pixel array 10 of the display device 100 of FIG. 1 according to an exemplary embodiment. In detail, pixel 60 may be pixel PXij illustrated in FIG. 1 situated where an i-th scan line SCANi and a j-th data line Dj cross each other among the plurality of pixels included in the pixel array 10 of FIG. 1. T circuit structure of the pixel PXij 60 connected to the i-th scan line SCANi and the j-th data line Dj is illustrated in detail in FIG. 4.

Referring to FIG. 4, the pixel 60 includes an organic light emitting diode (OLED) as its light emitting element and a pixel driving circuit for controlling the organic light emitting diode (OLED). The pixel driving circuit includes a driving transistor M1, a switching transistor M2, and a storage capacitor Cst.

FIG. 4 representatively illustrates the pixel structure that comprises two transistors and one capacitor, but the pixel circuit structure of the display device is not limited to the exemplary structure illustrated in FIG. 4 and may be variously configured.

In the pixel 60 of FIG. 4, the driving transistor M1 has its gate electrode connected to the drain electrode of the switching transistor M2. The source electrode of the driving transistor M1 receives a first power voltage ELVDD, and the drain electrode of the driving transistor M1 is connected to the anode of the organic light emitting diode (OLED). The cathode of the organic light emitting diode (OLED) is connected to the second power voltage ELVSS.

The first power voltage ELVDD is supplied (e.g., to the source electrode of the driving transistor M1) through the power wire 52 (see FIG. 1) connected to the power voltage supplier 50 as illustrated in FIG. 1.

The switching transistor M2 has its gate electrode connected to the scan line SCANi, its source electrode connected to the data line Dj, and its drain electrode connected to the gate electrode of the driving transistor M1.

The storage capacitor Cst has one of its electrodes connected to the gate electrode of the driving transistor M1, and its other electrode connected to a contact point (node) of the first power voltage ELVDD and the source electrode of the driving transistor M1. The storage capacitor Cst is charged by the data voltage sent to the pixel according to a pixel data voltage applied to the gate electrode of the driving transistor M1 through the switching transistor M2. The voltage charged in the storage capacitor Cst is maintained until the switching transistor M2 is turned ON again and then a new pixel data voltage is transferred to the storage capacitor Cst.

The organic light emitting diode (OLED) has an anode connected to the drain electrode of the driving transistor M1, and a cathode connected to the second power voltage ELVSS. The second power voltage ELVSS is supplied to the cathode of the organic light emitting diode (OLED) through a power wire 51 connected to the power voltage supplier 50 as illustrated in FIG. 1.

The driving transistor M1 and the switching transistor M2 comprised in the pixel of FIG. 4 may be both p-channel type transistors (e.g., PFET). Accordingly, the gate-ON voltage for turning ON the driving transistor M1 and switching transistor M2 is a low level voltage, and the gate-OFF voltage for turning OFF the driving transistor M1 and the switching transistor M2 is a high level voltage.

The pixel illustrated in FIG. 4 includes two p-channel type thin film transistors (M1 & M2), but the exemplary embodiment of the inventive concept is not limited thereto. At least one of the driving transistor M1 and the switching transistor M2 may be an n-channel transistor.

The organic light emitting diode (OLED) emits light according to a driving electric current IEL passing through it while the driving transistor M1 is turned ON.

During the operation of the pixel circuit of FIG. 4, first, when a scan signal corresponding to the gate-ON voltage is transmitted to the scan line SCANi, the switching transistor M2 is turned ON, and a pixel data voltage (hereinafter, a data voltage) according to a corresponding portion of the DATA signal is transferred to the first node N1 through the data line Dj.

Then, the pixel data voltage is applied to one electrode of the storage capacitor Cst connected to the first node N1. The first power voltage ELVDD is applied to the other electrode of the storage capacitor Cst, and the storage capacitor Cst is charged by a voltage corresponding to the difference in voltage between its two electrodes.

Thus, since the difference between the voltages applied to both electrodes of the storage capacitor Cst corresponds to the difference between the respective voltages applied to the gate electrode and the source electrode of the driving transistor M1, the storage capacitor Cst stores a voltage Vgs between the gate electrode and the source electrode of the driving transistor M1.

The ON/OF state of the driving transistor M1 controls the driving current IEL according to the voltage Vgs between its gate electrode and its source electrode.

Figure 5:
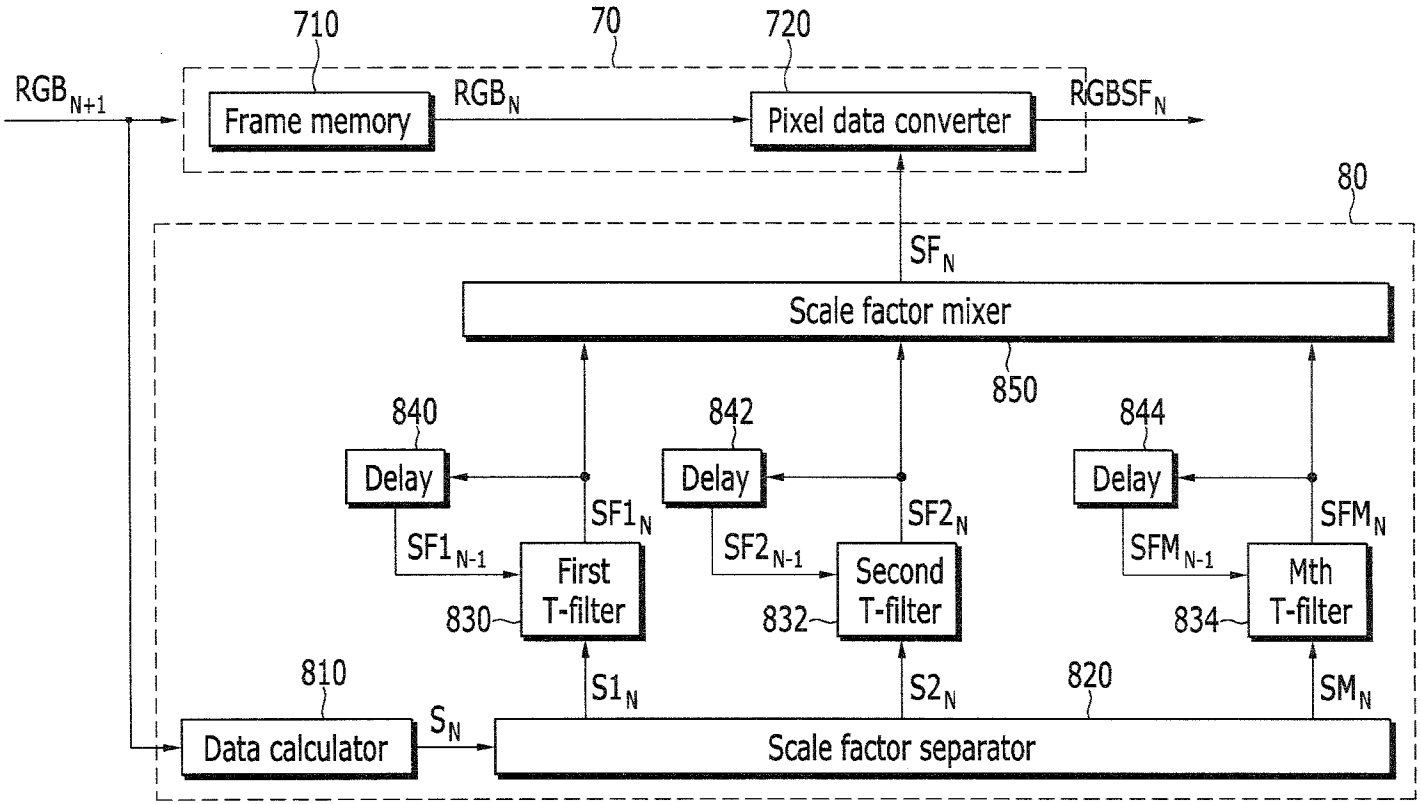
FIG. 5 is a block diagram of exemplary implementations of an image processor and of a scale factor generator in the display device of FIG. 1.

FIG. 5 is a block diagram of the image processor 70 and of the scale factor generator 80 according the exemplary embodiment of the inventive concept. As illustrated in FIG. 5, the image processor 70 includes a frame memory 710 and a pixel data converter 720. As illustrated in FIG. 3, a plurality M of image source signals may be included in each one frame of the image source signals RGB.

Referring to FIG. 5, the image processor 70 digitally image-processes the image source signals RGB and the scale factor generator 80 generates the scale factor SF corresponding to the image source signals RGB.

The frame memory 710 receives the image source signals RGB. The frame memory 710 delays an n-th frame image source signal $RGB_N$ to output the n-th frame image source signal $RGB_N$ to the pixel data converter 720, while a scale factor $SF_N$ of the n-th frame image source signal $RGB_N$ is generated (calculated) by the scale factor generator 80. Hereinafter, it is assumed that each frame image source signal (for example, the n-th frame image source signal $RGB_N$ is delayed by a 1 sub frame period by the frame memory 710.

The pixel data converter 720 receives the n-th frame image source signal $RGB_N$ from the frame memory 710 and receives the scale factor $SF_N$ of the n-th frame image source signal $RGB_N$ from the scale factor generator 80.

The pixel data converter 720 converts gray data of an image source signal $RGBSF_N$ of the n-th frame by using the received n-th frame image source signal $RGB_N$ and the scale factor $SF_N$. Hereinafter, the image source signal is referred to as the gray-converted image source signal $RGBSF_N$ of the n-th frame.

The pixel data converter 720 multiplies the image source signal $RGB_N$ of the n-th frame by the scale factor $SF_N$ of the n-th frame to generate the gray-converted image source signal $RGBSF_N$ of the n-th frame.

The scale factor generator 80 includes a data calculator 810, a scale factor separator 820, a plurality of M T-filters (e.g., 830, 832 to 834), a plurality of M delays (e.g., 840, 842 to 844 corresponding to the plurality of respective T-filters (e.g., 830, 832 to 834, and a scale factor mixer 850. In this case, the M T-filters 830 to 834 serve to filter a scale factor calculated in the data calculator 810 and separated in the scale factor separator 820, and it is not limited to a term of the T-filter.

The data calculator 810 receives the n-th frame image source signal $RGB_N$ to calculate the scale factor $S_N$ of the n-th frame image source signal $RGB_N$. In this case, since M image source signals are alternately arranged in the n-th frame, the scale factor corresponding to each image source signal is calculated.

For example, the data calculator 810 may calculate the electric current value I1 to be consumed in the pixel 60 included in the display device according to the first image source signal and a scale factor $S1_N$ corresponding to the first image source signal.

The electric current value I1 is calculated by using the n-th frame image source signal $RGB_N$ transferred to the data calculator 810. The scale factor $S1_N$ is a value acquired by dividing a predetermined threshold electric current value ITH into the electric current value I1.

Thus, the scale factor $S1_N$ corresponding to the first image source signal may be calculated as the following Equation 1:

$$S1_N = \frac{ITH}{I1} \quad \text{(Equation 1)}$$

In addition, the data calculator 810 calculates the scale factor $S1_N$ corresponding to the plurality of image source signals included in the rest of the n-th frame, and may transmit the scale factor $S_N$ to the scale factor separator 820 according to the arranged order of the first to M-th image source signals in the n-th frame image source signal $RGB_N$.

The scale factor separator 820 generate M signals by separating the scale factor $S_N$ according to each image. In addition, the scale factor separator 820 separates the scale factor $S_N$ transferred from the data calculator 810 into separated scale factors $S1_N$ to $SM_N$ for M images by using the generated signal to output the separated scale factors to the T-filters 830 to 834 corresponding to the respective images.

Hereinafter, a method of separating the scale factor $S_N$ by the scale factor separator 820 will be described with reference to FIG. 6.

Figure 6:
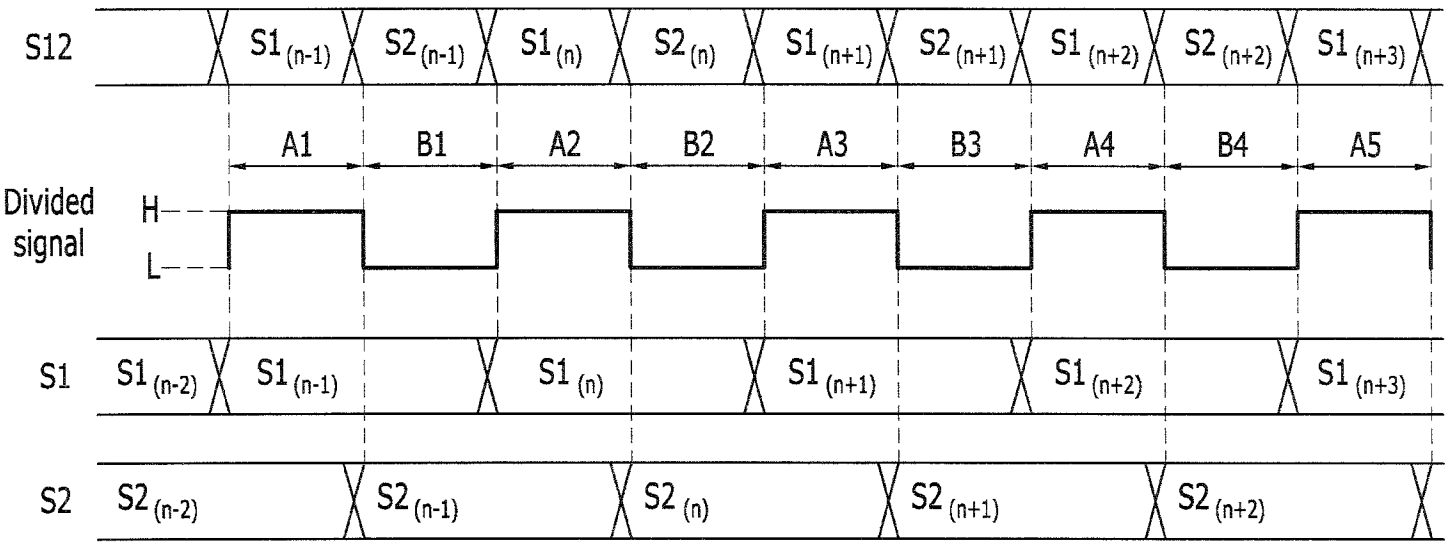
FIG. 6 is a timing diagram of signals of the display device of FIG. 1 illustrating a method of separating scale factors according to an exemplary embodiment of the inventive concept.

FIG. 6 is a timing diagram of signals of the display device of FIG. 1 illustrating a method of separating a scale factor $S_N$ according to an exemplary embodiment of the inventive concept. In FIG. 6, for convenience of description, it is assumed that a scale factor S12 generated from first and second image source signals RGB12 is separated to be outputted to first and second T-filters 830 and 832.

As illustrated in FIG. 6, the scale factor S12 calculated in the data calculator 810 is arranged in the order of a scale factor $S1_{N-1}$ for an (n−1)th frame first subframe, a scale factor $S2_{N-1}$ for an (n−1)th frame second subframe, a scale factor $S1_N$ for an n-th frame first subframe, a scale factor $S2_N$ for an n-th frame second subframe, a scale factor $S1_{N+1}$ for an (n+1)th frame first subframe, a scale factor $S2_{N+1}$ for an (n+1)th frame second subframe to be outputted to the scale factor separator 820.

Then, the scale factor separator 820 separates the scale factor S12 into the separated scale factors $S1_{N-1}$ to $S1_{N+1}$ for the first image (first subframe) and the separated scale factors $S2_{N-1}$ to $S2_{N+1}$ for the second image (second subframe) by using a scale factor division signal.

For example, during periods A1, A2, A3, A4, and A5 when the scale factor division signal is high H, the separated scale factors $S1_{N-1}$ to $S1_{N+1}$ for the first subframe may be separated from the scale factor S12. During periods B1, B2, B3, and B4 when the scale factor division signal is low L, the separated scale factors $S2_{N-1}$ to $S2_{N+1}$ for the second image may be separated from the scale factor S12 to be outputted to the T-filters 830 and 832, respectively.

Hereinabove, the method of separating the scale factors S1 and S2 for the each image from the scale factor S12 for the first image (first subframe) and the second image (second subframe) is described, but the scale factor separator 820 can separate a scale factor S for first to M-th images into M separated scale factors S1, S2, . . . , SM (one for each image) by differently setting sizes of the scale factor division signal by the number of image source signals, even when separating the scale factor S for the first to M-th images. The method of separating the scale factor S for the first to M-th images is not limited to the exemplary implementation shown.

Referring back to FIG. 5, the separated scale factors S1, S2, . . . , SM for each image may be outputted to the T-filter corresponding to each image. For example, the scale factor $S1_N$ of the n-th frame first subframe is outputted to the first T-filter 830, and the scale factor $S2_N$ of the n-th frame second subframe is outputted to the second T-filter 832.

Then, the first T-filter 830 calculates a scale factor of the present frame by using a scale factor of a previous frame according to a filter equation such as the following Equation 2:

$$SF1_N = SF1_{N-1} * (S1_N - SF1_{N-1}) \quad \text{(Equation 2)}$$

Herein, $SF1_{N-1}$ is the scale factor for the (n−1)th frame first subframe outputted from the first T-filter 830, $SF1_N$ is the scale factor for the n-th frame first subframe to be outputted from the first T-filter 830, $S1_N$ is the scale factor for the n-th frame first subframe outputted from the scale factor separator 820, and β is a constant number.

Meanwhile, the delay 840 stores the previous scale factor $SF1_{N-1}$ for the (n−1)th frame first subframe previously outputted from the first T-filter 830 and outputs the stored previous scale factor $SF1_{N-1}$ to the first T-filter 830.

The first T-filter 830 calculates the $SF1_N$ by Equation 2, when the scale factor separator 820 receives the scale factor $S1_N$ of the n-th frame first subframe and the delay 840 receives the scale factor $SF1_{N-1}$ for the (n−1)th frame first subframe.

Hereinabove, the method of calculating the scale factor $SF1_N$ of the n-th frame first subframe in the T-filter 830 and the delay 840 is described, but the method may be equally applied to even a case where a scale factor $SFM_N$ of the n-th frame M-th image is calculated.

In addition, the T-filters 830 to 834 outputs the calculated separated scale factors $SF1_N$ to $SFM_N$ of the n-th frame of the first to m-th images to the scale factor mixer 850.

Next, the scale factor mixer 850 outputs the separated scale factors $SF1_N$ to $SFM_N$ of the first to m-th images of the n-th frame outputted from the respective T-filters 830 to 834 to the pixel data converter 720.

Hereinafter, a method of outputting the separated scale factors $SF1_N$ to $SFM_N$ outputted from the T-filters 830 to 834 to the pixel data converter 720 by the scale factor mixer 850 will be described with reference to FIG. 7.

Figure 7:
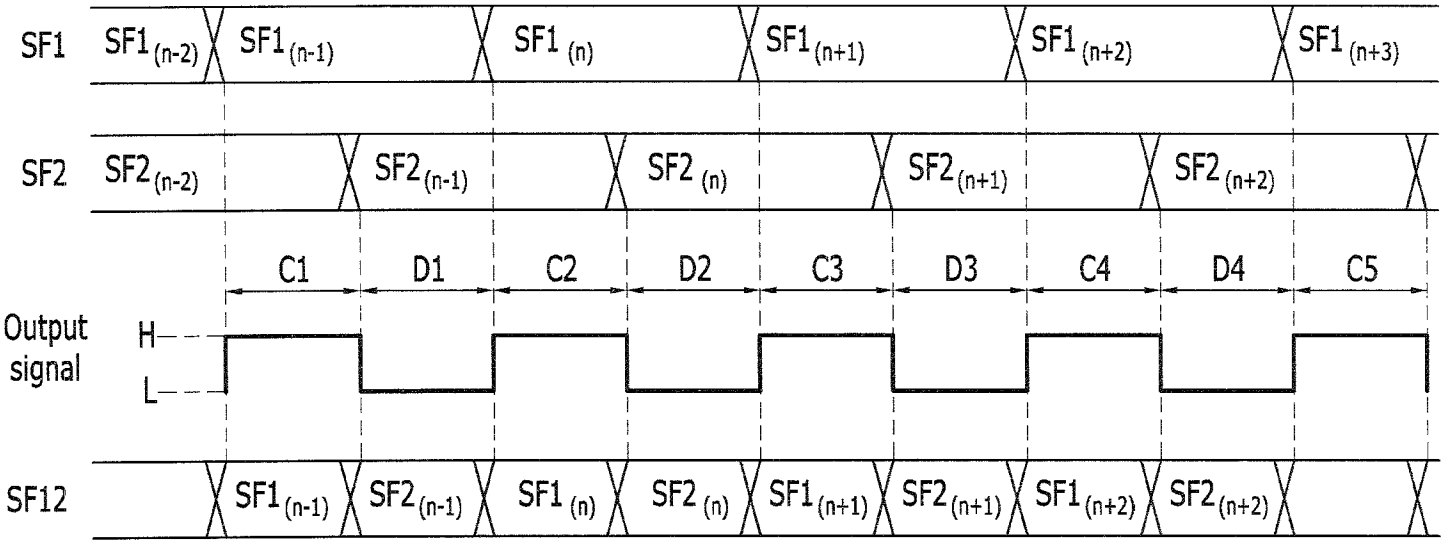
FIG. 7 is a timing diagram of signals of the display device of FIG. 1 illustrating a method of outputting a scale factor from the scale factor mixer according to an exemplary embodiment of the inventive concept.

FIG. 7 is a timing diagram of signals of the display device of FIG. 1 illustrating a method of outputting a scale factor SF12 from the scale factor mixer 850 according to an exemplary embodiment of the inventive concept.

As illustrated in FIG. 7, the scale factor mixer 850 can output a scale factor SF1 for the first image (first subframe) and a scale factor SF2 for the second image (second subframe) to the pixel data converter 720 by using a scale factor output signal.

For example, the scale factor mixer 850 can output the scale factor SF1 for the first image to the pixel data converter 720 during periods C1, C2, C3, C4, and C5 when the scale factor output signal is high H. And, the scale factor mixer 850 can output the scale factor SF2 for the second image to the pixel data converter 720 during periods D1, D2, D3, and D4 when the scale factor output signal is low L.

Thus, the scale factor mixer 850 can alternately output the scale factor SF1 for the first image and the scale factor SF2 for the second image to the pixel data converter 720.

Referring back to FIG. 5, the pixel data converter 720 generates the gray-converted first and second image source signals $RGBSF_N$, by multiplying the first image among the first and second source signals $RGB_N$ of the n-th frame received from the frame memory 710 by the scale factor $SF1_N$ for the n-th frame of the first image, and multiplying the second image among the first and second source signals $RGB_N$ of the n-th frame by the scale factor $SF2_N$ for the n-th frame of the second image.

Hereinafter, a method of generating and outputting a gray-converted image source signal RGBSF by using image source signals RGB and a scale factor SF in the display device according to an exemplary embodiment of the inventive concept will be described with reference to FIGS. 8 and 9.

Figure 8A:
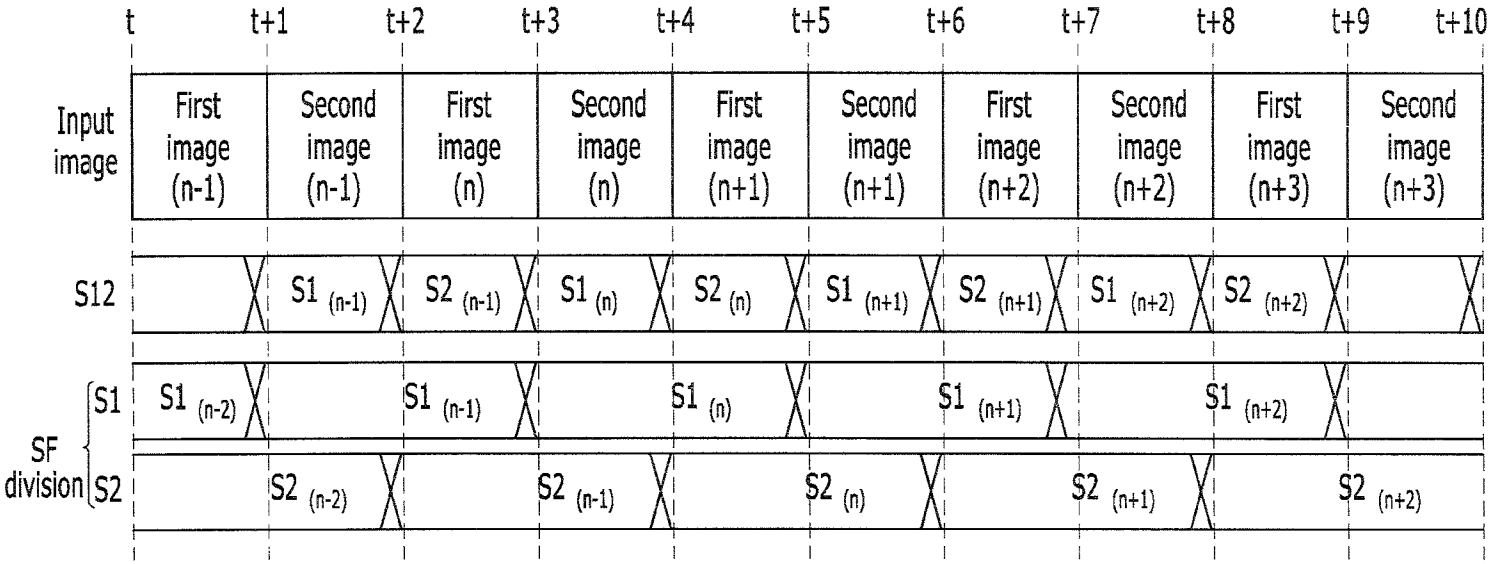
FIGS. 8A and 8B are a timing diagram illustrating a first exemplary method of processing an image by using image information and a scale factor of the display device of FIG. 1.

First, FIG. 8 is an timing diagram illustrating a first exemplary method of processing an image by using an image source signal and a scale factor of the display device of FIG. 1. As illustrated in FIG. 8A, when the first and second image source signals are inputted, the data calculator 810 calculates a scale factor S12 by using the first and second image source signals and outputs the calculated scale factor to the scale factor separator 820.

In addition, for each frame, the scale factor S12 is separated into a scale factor S1 for the first image and a scale factor S2 for the second image by the scale factor separator 820 to be outputted to each of the T-filters 830 and 832.

Figure 8B:
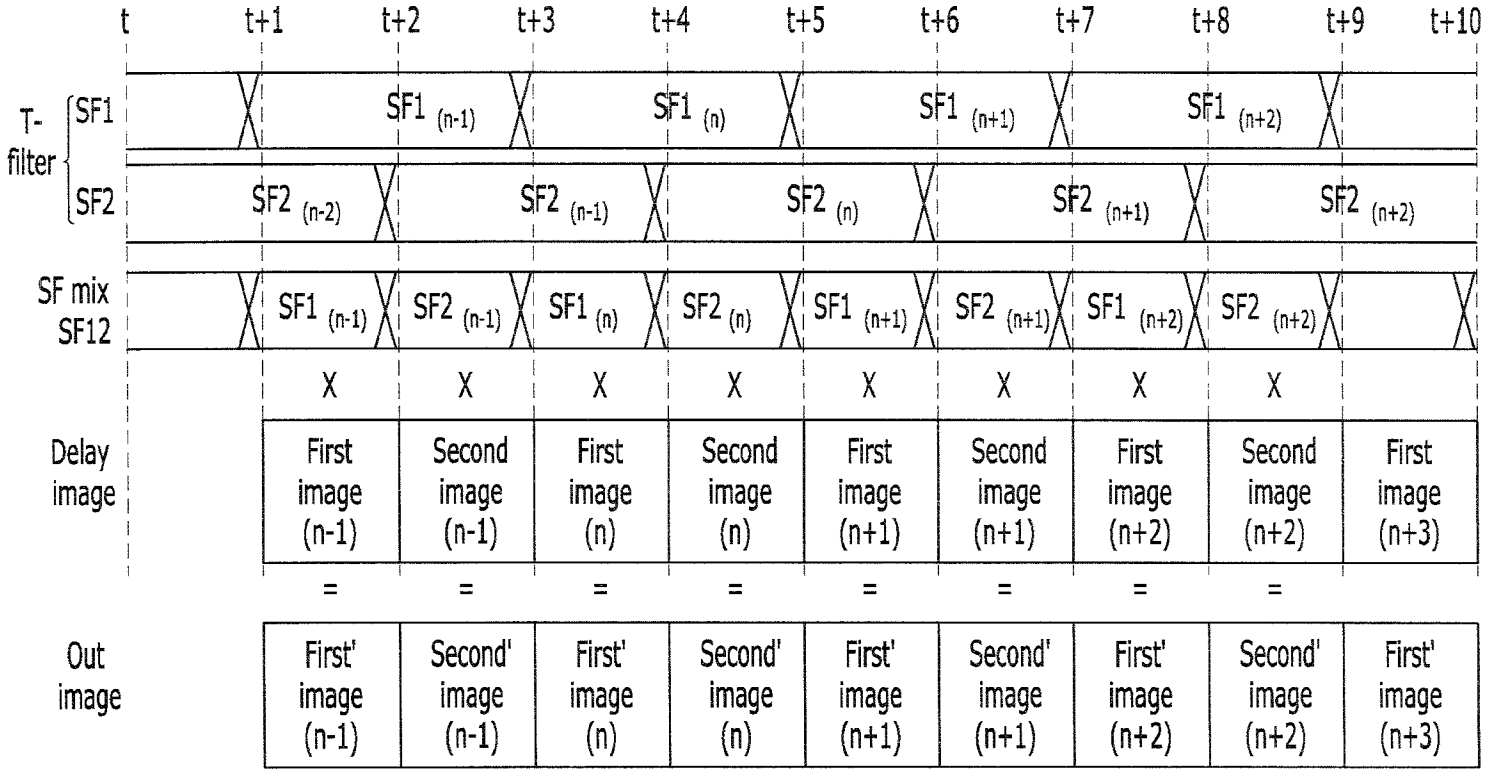

Then, as illustrated in FIG. 8B, the respective T-filters 830 and 832 calculate the correction scale factors SF1 and SF2 of a present frame by using a correction scale factor for a previous frame and the scale factors S1 and S2 outputted from the scale factor separator 820 to output the calculated correction scale factors SF1 and SF2 to the scale factor mixer 850.

The correction scale factor SF1 for the first image and the correction scale factor SF2 for the second image may be outputted to the pixel data converter 720 as the correction scale factor SF12 for the first and second images by the scale factor mixer 850. For example, the correction scale factor SF12 for the first and second images may be a signal outputted when the scale factor SF1 for the first image and the scale factor SF2 for the second image are arranged by a 1 subframe unit.

The pixel data converter 720 can output the first and second image source signals RGBSF which are gray-converted by multiplying the delayed first and second image source signals RGB by the scale factor SF12 for the first and second images.

Figure 9A:
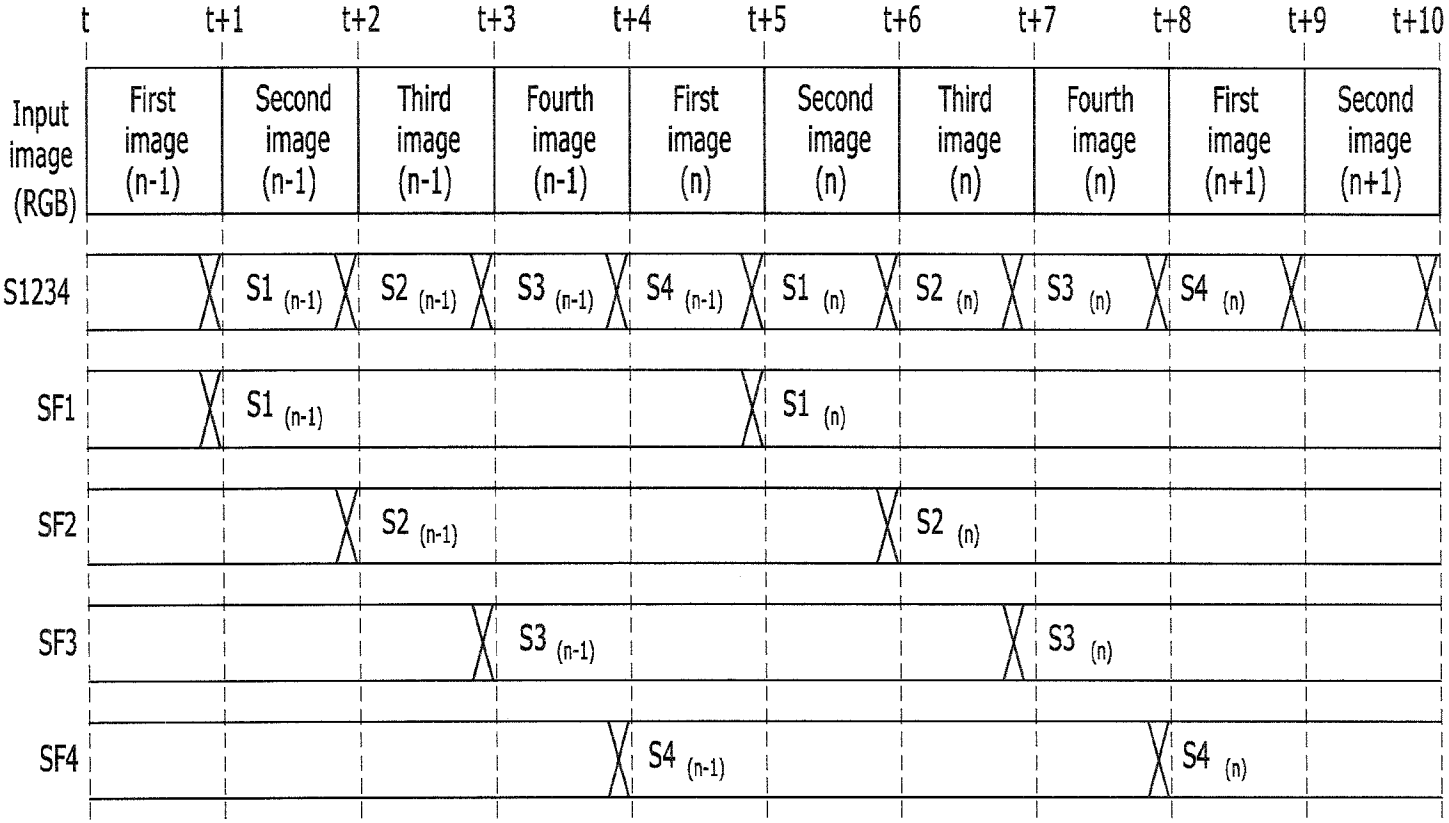
FIGS. 9A and 9B are a timing diagram illustrating a second exemplary method of processing an image by using image information and a scale factor of the display device of FIG. 1.

FIG. 9 is a timing diagram illustrating a second exemplary method of processing an image by using an image source signal and a scale factor of the display device of FIG. 1. As illustrated in FIG. 9A, when the first to fourth image source signals are inputted, the data calculator 810 calculate a scale factor S1234 by using the first to fourth image source signals and outputs the calculated scale factor S1234 to the scale factor separator 820.

And, the scale factor S1234 is separated into a scale factor S1 for the first image, a scale factor S2 for the second image, a scale factor S3 for the third image, and a scale factor S4 for the fourth image by the scale factor separator 820 to be outputted to corresponding T-filters.

Then, the corresponding T-filters generate correction scale factors SF1, SF2, SF3, and SF4 of a present frame by using a correction scale factor for a previous frame image and the scale factors S1, S2, S3, and S4 outputted from the scale factor separator 820 to output the calculated correction scale factors SF1, SF2, SF3, and SF4 to the scale factor mixer 850.

Figure 9B:
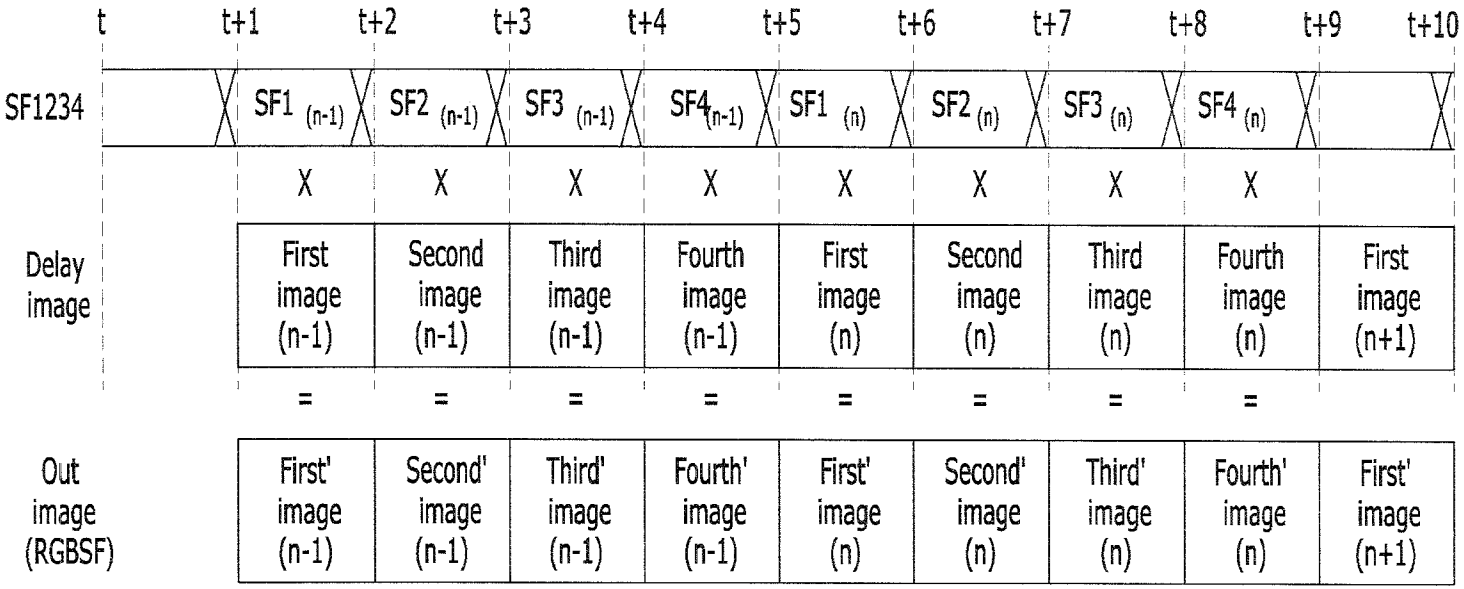

As illustrated in FIG. 9B, the scale factor SF1 for the first image, the scale factor SF2 for the second image, the scale factor SF3 for the third image, and the scale factor SF4 for the fourth image may be outputted by the scale factor mixer 850 to the pixel data converter 720 in the form of a scale factor SF1234 for the first to fourth images.

The pixel data converter 720 outputs the gray-converted first to fourth image source signals RGBSF, by multiplying the delayed first to fourth image source signals RGB by the scale-factor SF1234 for the first to fourth images.

The drawings referred to in the above and disclosed description of the inventive concept only illustrate the inventive concept, and are intended to describe the inventive concept, not to restrict the meanings or the scope of the inventive concept claimed in the claims. Therefore, the scope of the inventive concept must be determined by the scope of the claims and the equivalent, not by the described embodiments.

| <Description of symbols> | |
|---|---|
| 10: Pixel array | 20: Scan driver |
| 30: Data driver | 40: Controller |
| 50: Power voltage supplier | 60: Pixel |
| 70: Image processor | 80: Scale factor generator |
| 710: Frame memory | 712: Pixel data converter |
| 810: Data calculator | 812: Scale factor separator |
| 830-834: T-filter | 840-844: Delay |
| 850: Scale factor mixer | |

What is claimed is:

1. A display device for displaying a plurality of subframes within one frame period according to an image source signal, the device comprising:

a pixel array including a plurality of pixels; each of the pixels configured to display during the one frame period a plurality of images, each image of the plurality of images being displayed during a respective subframe in the one frame period; wherein each image of the plurality of images are arranged in the image source signal during the one frame period, a scale factor generator configured to:

separately calculate electric current values to be consumed during the respective subframes displayed within the one frame period to correspond to each of the subframes, separately calculate initial scale factors that correspond to the respective subframes by comparing each of the electric current values with a threshold electric current value respectively, and separately generate correction scale factors that correspond to the respective subframes by using the initial scale factor that corresponds to the respective subframes and a correction scale factor that corresponds to the respective subframes of a previous frame; and an image processor configured to separately change a gray data of each of the images arranged in the image source signal during the one frame period by using the correction scale factors.

2. The display device of claim 1, wherein: the initial scale factor is from an arranged order of subframes within the one frame period.

3. The display device of claim 2, wherein:

the scale factor generator includes a data calculator configured to calculate the initial scale factor by using the image source signal; and a plurality of filter units configured to correct the initial scale factor by using the difference between a correction scale factor of a previous frame and the initial scale factor to generate a correction scale factor for the one frame period.

4. The display device of claim 3, wherein: the scale factor generator further includes a scale factor separator that separates the initial scale factor to correspond to the plurality of subframes according to a scale factor division signal and outputs each of the separated scale factors to the corresponding filter unit.

5. The display device of claim 4, wherein: the scale factor generator further includes a first memory that delays a correction scale factor of a previous frame to the one frame period to output the delayed correction scale factor to the filter unit.

6. The display device of claim 1, wherein: the image processor includes a pixel data converter converting a gray data by multiplying the image source signal of the one frame period by a correction scale factor for the one frame period.

7. The display device of claim 6, wherein: the image processor includes a second memory for delaying the image source signal of the one frame period to output the delayed image source signal to the pixel data converter based on a period when the corrected scale factor is outputted from the scale factor generator.

8. The display device of claim 1, wherein: the image source signal is arranged in an order in which the plurality of subframes is displayed in the pixel array within the one frame period.

9. The display device of claim 1, wherein: the plurality of subframes is separated and arranged by a plurality of unit display periods within the one frame period.

10. The display device of claim 1, wherein: the initial scale factor and the correction scale factor are larger than 0 and equal to or smaller than 1.

11. A control method of a display device, comprising:

separately calculating electric current values of the electric current to be consumed in a pixel array by each of a plurality of subframes to be displayed within a frame period according to an image source signal during the frame period; wherein the pixel array includes a plurality of pixels; each of the pixels configured to display during the frame period a plurality of images, each image of the plurality of images being displayed during a respective subframe in the frame period; wherein each image of the plurality of images are arranged in the image source signal during the frame period, separately calculating initial scale factors that correspond to the respective subframes by comparing each of the electric current values with a threshold electric current value respectively;

separately generating correction scale factors that correspond to the respective subframes by using the initial scale factor that corresponds to the respective subframes and a correction scale factor that corresponds to the respective subframes of a previous frame; and separately changing a gray data of each of the images arranged in the image source signal during the frame period by using the correction scale factors.

12. The control method of a display device of claim 11, wherein: the initial scale factor is from an arranged order of subframes within the one frame period.

13. The control method of a display device of claim 12, wherein: the generating of the correction scale factor of the frame period includes separating the initial scale factor to correspond to the plurality of subframes according to a scale factor division signal.

14. The control method of a display device of claim 13, Wherein: the correcting of the initial scale factor further includes correcting the initial scale factor by using the difference between a correction scale factor of a previous frame and the initial scale factor to generate a correction scale factor for the frame period.

15. The control method of a display device of claim 14, wherein: the correcting of the initial scale factor further includes delaying a correction scale factor of the previous frame in order to calculate the difference between the initial scale factor and the correction scale factor of the previous frame.

16. The control method of a display device of claim 11, wherein: the converting of the gray data of the image source signal of the frame period includes converting a gray data by multiplying the image source signal of the frame period by the correction scale factor of the frame period.

17. The control method of a display device of claim 16, wherein: the converting of the gray data of the image source signal of the frame period further includes delaying the image source signal of the frame period based on a period when the corrected scale factor is outputted.

18. The control method of a display device of claim 11, wherein: the image source signal is arranged in an order in which the plurality of subframes is displayed in the pixel array within the one frame period.

19. The control method of a display device of claim 11, wherein: the plurality of subframes is separated and arranged by a plurality of unit display periods within the one frame period.

20. The control method of a display device of claim 11, wherein: the initial scale factor and the correction scale factor are larger than 0 and equal to or smaller than 1.

21. A display device for displaying a plurality of subframes within a frame period according to an image source signal, the device comprising:

a pixel array including a plurality of pixels; each of the pixels displaying during a first frame period and a second frame period a plurality of images, each image of the plurality of images being displayed during a respective subframe in the first frame period and the second frame period; wherein each image of the plurality of images are arranged in the image source signal during the first frame period and the second frame period, a scale factor generator configured to:

separately calculate electric current values to be consumed during respective subframes displayed within one frame period to correspond to each of the subframes, separately calculate initial scale factors that correspond to the respective subframes by comparing each of the electric current values with a threshold electric current value respectively, and separately generate correction scale factors that correspond to the respective subframes by using the initial scale factor that corresponds to the respective subframes and a correction scale factor that corresponds to the respective subframes of a previous frame; and an image processor configured to separately change a gray data of each of the images arranged in the image source signal during the first frame period and the second frame period by using the correction scale factors.

* * * * *